US008009104B2

(12) United States Patent
Hossain

(10) Patent No.: US 8,009,104 B2
(45) Date of Patent: Aug. 30, 2011

(54) SINGLE LAYER ADAPTIVE PLANE ARRAY ANTENNA AND VARIABLE REACTANCE CIRCUIT

(75) Inventor: Golam Sorwar Hossain, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 371 days.

(21) Appl. No.: 12/403,527

(22) Filed: Mar. 13, 2009

(65) Prior Publication Data

US 2009/0309799 A1 Dec. 17, 2009

(30) Foreign Application Priority Data

Jun. 17, 2008 (JP) ..... 2008-158324

(51) Int. Cl.
*H01Q 1/38* (2006.01)

(52) U.S. Cl. ..... 343/700 MS; 343/861

(58) Field of Classification Search ..... 343/700 MS, 343/850, 853, 833, 834, 860, 864
See application file for complete search history.

(56) References Cited

U.S. PATENT DOCUMENTS

| | | | | |
|---|---|---|---|---|
| 2007/0182639 | A1* | 8/2007 | Sievenpiper et al. .. | 343/700 MS |
| 2007/0279286 | A1* | 12/2007 | Coutts et al. ..... | 343/700 MS |
| 2008/0088510 | A1* | 4/2008 | Murata et al. ..... | 343/700 MS |
| 2008/0266179 | A1* | 10/2008 | Sotoudeh et al. ..... | 343/700 MS |

FOREIGN PATENT DOCUMENTS

| | | |
|---|---|---|
| JP | 2005-159401 | 6/2005 |
| JP | 2007-267041 | 10/2007 |

* cited by examiner

*Primary Examiner* — HoangAnh T Le
(74) *Attorney, Agent, or Firm* — Katten Muchin Rosenman LLP

(57) ABSTRACT

A single-layer adaptive plane array antenna device includes a variable reactance circuit including a variable capacitance circuit controlled by bias voltage, a resonating folded line bias circuit having an AC grounding node for supplying the bias voltage to the variable capacitance circuit, for transmitting the bias voltage to the variable capacitance circuit including a thin line interconnecting spacer for transmitting the bias voltage to the variable capacitance circuit side and first and second open folded stubs each of which is connected to the thin line interconnecting spacer, each of which is also disposed in parallel with a longitudinal direction of each other in a prescribed small gap with the thin-line interconnecting spacer, each of which has a folded shape and each of which functions as an inductance element and a capacitance element respectively for separating the variable capacitance circuit from the AC grounding node.

11 Claims, 6 Drawing Sheets

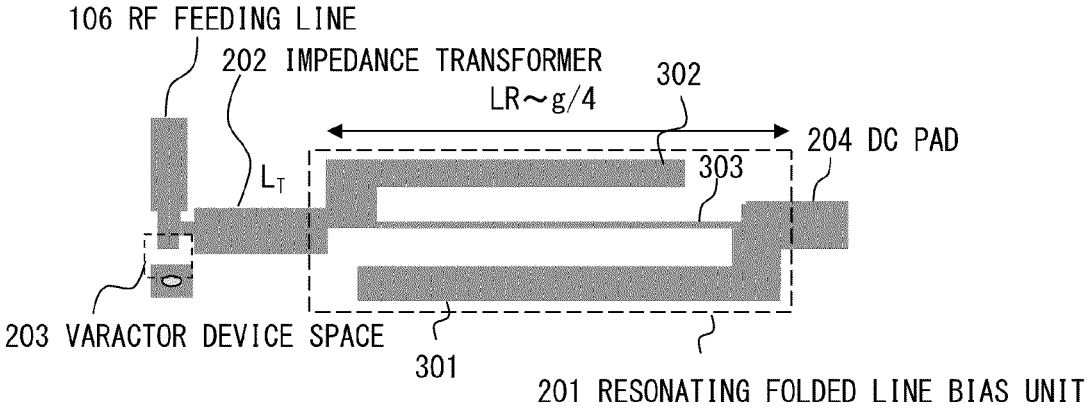
FIG. 4A SINGLE-FOLDED RESONATOR
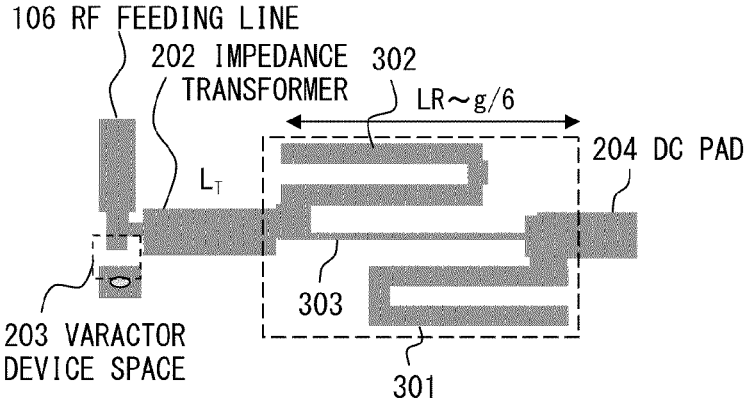
FIG. 4B DOUBLE-FOLDED RESONATOR
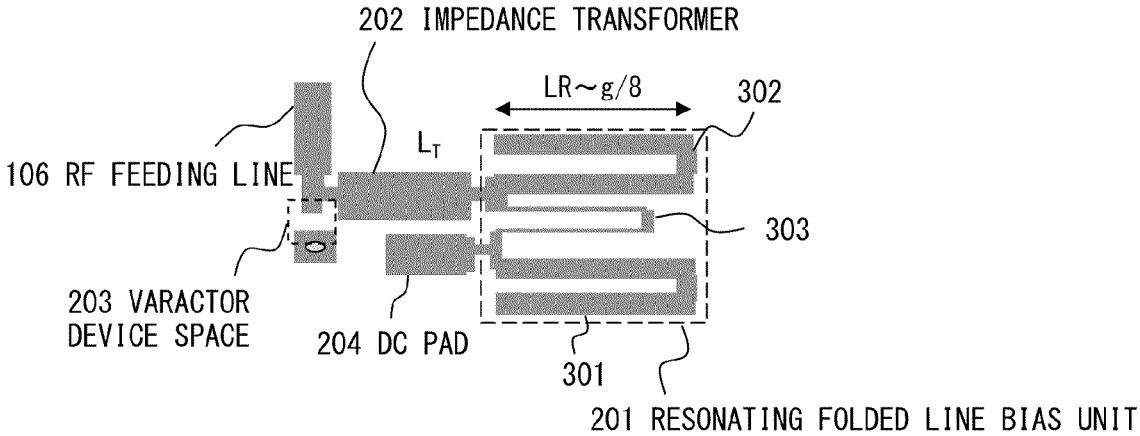
FIG. 4C MULTI-FOLDED RESONATOR

SINGLE LAYER ADAPTIVE PLANE ARRAY ANTENNA AND VARIABLE REACTANCE CIRCUIT

CROSS-REFERENCE TO RELATED APPLICATION

This application is based upon and claims the benefit of priority of the prior Japanese Patent Application No. 2008-158324, filed on Jun. 17, 2008, the entire contents of which are incorporated herein by reference.

FIELD

The embodiments discussed herein are related to an adaptive antenna having a compact variable reactance circuit.

BACKGROUND

A plane micro-strip type adaptive ESPAR (electronically steerable passive array radiator) antenna array has advantages of low profile, compact structure, low weight, low production cost and the like.

The operation principle of an ESPAR antenna has two types of radiant elements in an array. One central element is called active element and the other is called passive element (or parasitic element). These passive elements are disposed symmetrically to the central active element in such a way to behave like a passive radiator by picking up electro-magnetic coupling.

The parasitic element is connected to a variable reactance passive circuit. The amount of coupling basically depends on a variable reactance value changing an input excitation phase. Thus, beam steering is generated in the array and the directivity of the antenna can be controlled.

In the design of a plane ESPAR antenna, conventionally a multi-layer type in which a variable reactance RF circuit is installed in a layer different from the layer of a printed-circuit board (PCB) mounting an antenna element is popular.

The followings are prior technical documents related to a plane ESPAR antenna technique and presume multi-layer structures.

Patent document 1: Japanese Laid-open Patent Publication No. 2005-159401

Patent document 2: Japanese Laid-open Patent Publication No. 2007-267041

SUMMARY

However, a multi-layer plane ESPAR antenna has limitations in the miniaturization of an antenna module and it is difficult to mount it on a small electronic device.

Therefore, it is preferable to mount a small single-layer PCB plane ESPAR antenna on a small electronic device. However, conventionally it is difficult to install a high-performance variable reactance RF circuit in a small PCB in the same layer as a layer on which an antenna element is mounted.

More particularly, it is very difficult to design the layout of a variable reactance RF circuit which can be disposed in the little space of a PCB layer mounting an antenna element.

Furthermore, an interconnecting function due to the fact that an antenna element and a component of the variable reactance RF circuit come close to each other and the function of the antenna degrades.

The fact that an antenna element and a component of the variable reactance RF circuit come close to each other also causes false radiation and degrades the function of the antenna.

According to an aspect of the embodiment, an adaptive antenna presumes a single-layer adaptive plane array antenna device mounting an antenna array unit implementing an active antenna element and two or more passive antenna elements, and two or more variable reactance circuit each of which is connected to each of the passive antenna elements and changes reactance of a signal supplied to each of the passive antenna elements on the same printed-circuit board, or only a variable reactance circuit.

The variable reactance circuit includes the following variable capacitance circuit, resonating folded-line bias circuit and impedance transformer circuit.

The variable capacitance circuit can control capacitance on the basis of bias voltage.

The resonating folded line bias circuit has an AC grounding node for supplying bias voltage to the variable capacitance circuit and includes a thin-line interconnecting spacer for transmitting bias voltage to the variable capacitance circuit side in order to form a resonant circuit for realizing an AC grounding node, first and second open folded stubs, each of which is connected to the thin-line interconnecting spacer, each of which is disposed in parallel with the longitudinal direction in a very small prescribed gap (Lcp) with it, each of which has a folded shape and which function as an inductance element and a capacitive element, respectively. The first and second open folded stubs are disposed, for example, in such a way that folding direction of each stub is opposite to each other. The first and second open folded stubs are disposed, for example, in such a way that their longitudinal directions may coincide with the polarization direction (H pole) of the antenna array unit. Furthermore, for example, the length in the longitudinal direction of each of the first and second open folded stubs is different and the length in the longitudinal direction of both is ¼ or less of the basic wavelength of a signal supplied to the passive antenna element by the variable reactance circuit. Furthermore, for example, the length in the longitudinal direction of the first open folded stub is longer than the length in the longitudinal direction of the second open folded stub. Furthermore, for example, the length in the longitudinal direction of the thin-line interconnecting spacer is ¼ or less of the basic wavelength of a signal supplied to the passive antenna element by the variable reactance circuit. Furthermore, for example, each of the first and second open folded stubs can be also folded twice or more. Furthermore, the thin-line interconnecting spacer can be also folded.

The impedance transformer circuit separates the variable capacitance circuit from the AC grounding node.

In the structure in the aspect of the above-described adaptive antenna, the variable reactance circuit can be also disposed in the right angle against the signal feeding line of the passive antenna element connected to it.

In the structure in the aspect of the above-described adaptive antenna, the antenna array unit and each variable reactance circuit can be mounted on the top surface of the printed-circuit board and its grounding surface can be mounted on the other surface of the printed-circuit board.

The object and advantages of the embodiment will be realized and attained by means of the elements and combinations particularly pointed out in the claims.

It is to be understood that both the foregoing general description and the following detailed description are exemplary and explanatory and are not restrictive of the embodiment, as claimed.

BRIEF DESCRIPTION OF DRAWINGS

FIG. 4 illustrates the structures of its different preferred embodiments instead of the structure of the variable reactance RF unit 104 illustrated in FIGS. 1 and 2;

FIG. 6 illustrates the approximate concentrated constant element equivalent model for explaining the operation principle of the variable reactance RF unit 104 illustrated in FIGS. 2, 3 and the like.

DESCRIPTION OF EMBODIMENTS

Preferred embodiments of the present invention will be explained with reference to accompanying drawings.

Figure 1:
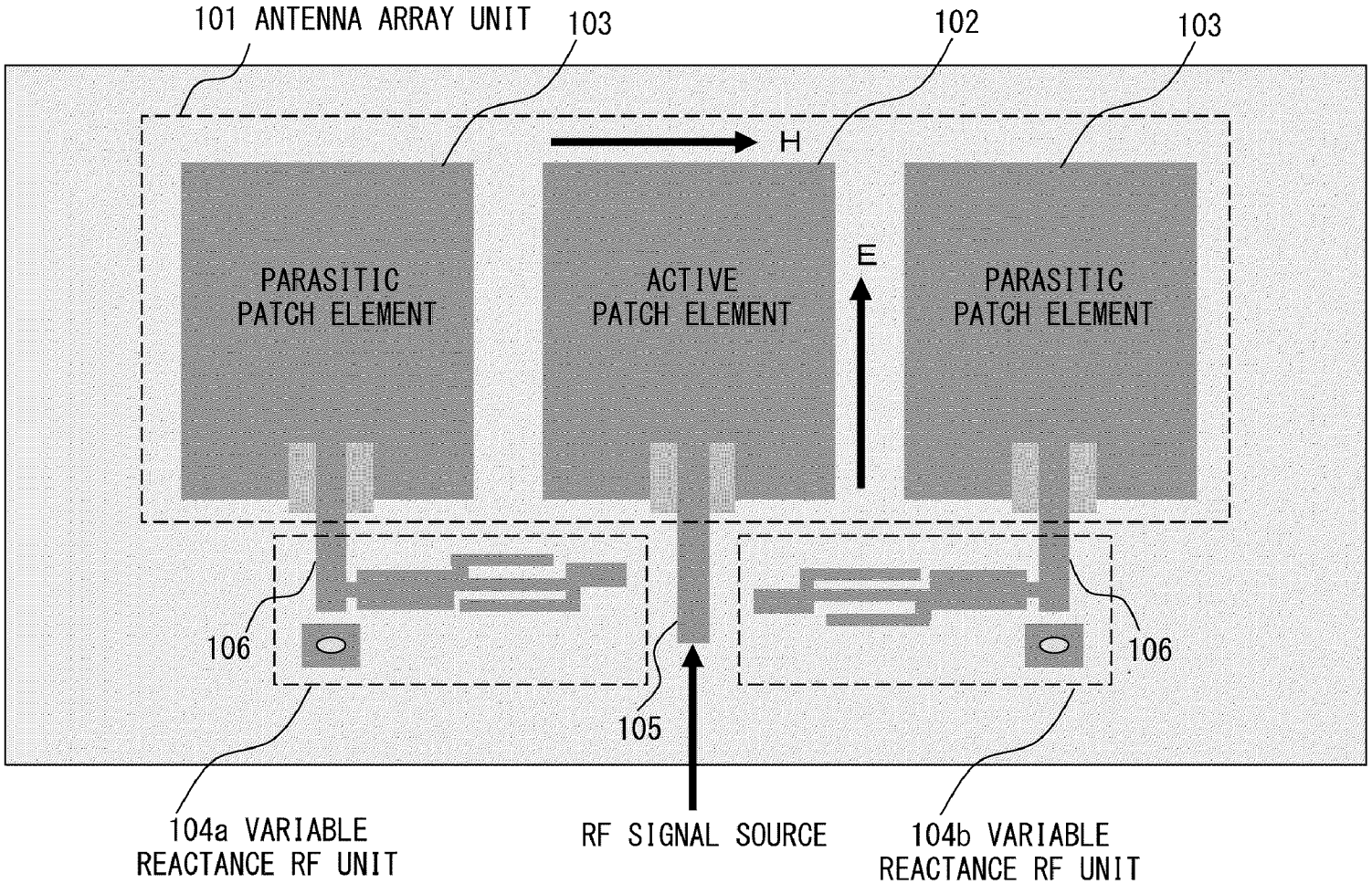
FIG. 1 illustrates the layout of a single-layer plane adaptive array antenna.

FIG. 1 illustrates the layout of a single-layer plane adaptive array antenna.

This configuration includes an antenna array unit 101 and a variable reactance RF units 104(*a* and *b*).

The antenna array unit 101 includes three plane antenna elements. An active patch element 102 being a central antenna element is supplied with an RF signal source via an RF feeding line 105 of 50-ohm matching. Parasitic patch elements 103*a* and 103*b* being the other two antenna elements on both sides is connected to variable reactance RF units 104*a* and 104*b*, respectively, via 50-ohm RF feeding line 106*a* and 106*b*, respectively.

As the input reactance of each of the plane antenna elements changes, the antenna array unit 101 adaptively forms a beam capable of directing it to a desired direction.

The configuration in FIG. 1 illustrates a three-element ESPAR array antenna and the active patch element 102 and the parasitic patch elements 103*a* and 103*b* constitute an inset feeding type rectangular micro-strip patch antenna array.

Figure 2:
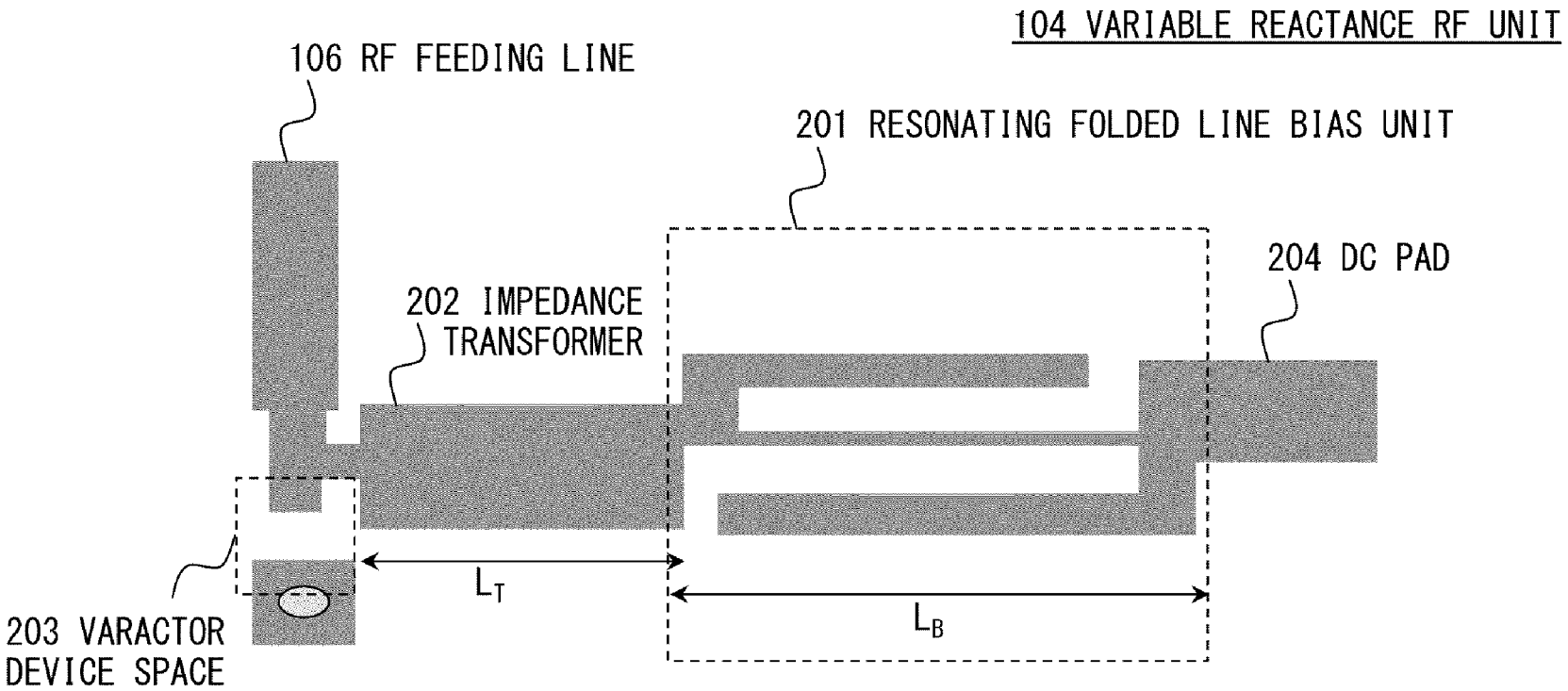
FIG. 2 illustrates the detailed common layout of the variable reactance RF unit illustrated in FIG. 1.

FIG. 2 illustrates the detailed common layout of the variable reactance RF units 104*a* and 104*b* illustrated in FIG. 1 (described as a variable reactance RF unit in FIG. 2).

This circuit includes three different parts, which are the resonating folded line (RFL) bias unit 201 realized by its resonating folded line (RFL), an impedance transformer 202 realized by a transmission line and a variable capacitance (varactor) device inserted in the varactor device space 203 in FIG. 2.

Besides, the configuration in FIG. 2 includes a DC pad 204 to which a DC voltage power source is connected and RF feeding lines 106 (corresponding to 106*a* and 106*b* in FIG. 1) connected to the parasitic patch elements 103 (103*a* and 103*b* in FIG. 1).

The resonating folded line bias unit 201 is installed at a right angle against the RF feeding line 106 together with the impedance transformer 202 in such a way that the variable reactance RF unit 104*a* in FIG. 1 is accommodated in small space between the RF feeding line 105 of the active patch element 102 and the RF feeding line 106*a* of the parasitic patch element 103*a* and that the variable reactance RF unit 104*b* in FIG. 1 is accommodated in small space between the RF feeding line 105 of the active patch element 102 and the RF feeding line 106*b* of the parasitic patch element 103*b*.

Figure 3:
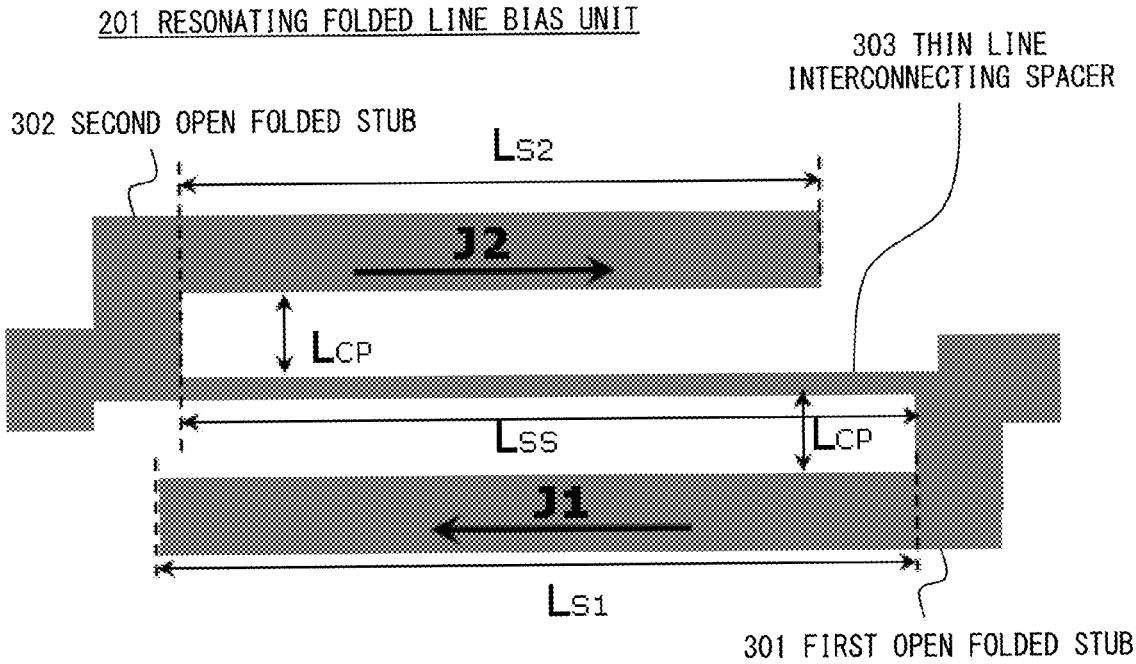
FIG. 3 illustrates the further detailed layout of the resonating folded-line bias unit illustrated in FIG. 2.

FIG. 3 illustrates the further detailed layout of the resonating folded line bias unit 201 illustrated in FIG. 2.

The resonating folded line bias unit 201 includes three elements, which are the first open folded stub 301, the second open folded stub 302 and a thin-line interconnecting spacer 303.

The first open folded stub 301 and the second open folded stub 302 are jointed by the thin-line interconnecting spacer 303. When a free gap Lcp is provided between 301 and 303, and 302 and 303, the first open folded stub 301 behaves like an inductive stub and simultaneously the second open folded stub 302 behaves like a capacitive stub. As a result, the resonating folded line bias unit 201 continues continuous resonance to cause AC grounding in an operating frequency.

The thin line interconnecting spacer 303 also suppliers a DC voltage supply pulse from the DC pad 204 (FIG. 2) to the variable capacitance (varactor) device inserted in the varactor device space 203 (FIG. 2).

By this thin line interconnecting spacer 303, the folded stub group 301 and 302 are approached each other. Thereby, the resonator becomes compact and also a larger interconnection can be realized.

By strong interconnection between the folded stub groups 301 and 302, the length of both the stubs Ls1 and Ls2 and the length Lss of the thin-line interconnecting spacer 303 can be shorten less than ¼ of the basic wavelength (λ0/4). These length differs from one proposed in the prior patent application (Application No. PCT/JP2007/065800) by this applicant.

The connection gap illustrated in FIG. 3 is maintained a possible minimum (approximately λ0/100).

In this case, the dimensions of the resonating folded line bias unit 201 can be obtained by an optimization method using full 3D electromagnetic simulation. The dimensions of the two open folded stubs 301 and 302 and the thin-line interconnecting spacer 303 can be adjusted until RF grounding or zero input impedance can be obtained in the resonating folded line bias unit 201.

Since the resonating folded line bias unit 201 behaves like AC grounding, it provides insulation between an RF (high frequency) signal and a DC voltage.

The resonating folded line bias unit 201 also provides AC grounding for the impedance transformer 202 (see FIG. 2). As a result, since it provides a convenient reactance change for each of the RF feeding lines 106*a* and 106*b* of the parasitic patch elements 103*a* and 103*b* (see FIG. 1) in the antenna array unit 101, it realizes an LC tank circuit together with the variable capacitance device inserted in the varactor device space 203.

In the above-described prior patent application by this applicant, a reactance circuit called resonating dual choke (RDC) variable reactance circuit, used in a two-layer PCB structure is proposed. This RDC circuit includes a double open stub choke bias unit which has an insulation function between the RF and DC circuits of the variable reactance circuit.

Since this bias circuit has zero input impedance, it can eliminate any parasitic impedance that appears in a bias circuit and displays good performance. However, when the single-layer shaped PCB is adopted, it is difficult to arrange a variable reactance RF unit composed of a RDC together with an antenna array unit in the single layer since the structure of the RDC is not sufficiently compact. Furthermore, in a single-layer structure, when an antenna element and the component of a variable reactance RF circuit are positioned close to each other, an interconnecting function and false radiation occur and the performance of an antenna degrades. This preferred embodiment solves these problems. Its reason will be described later.

FIG. 4 illustrates the structures of its different preferred embodiments instead of the structure of the variable reactance RF unit 104 illustrated in FIGS. 1 and 2.

Each preferred embodiment in FIGS. 4A, 4B and 4C illustrates a different type of an RFL (resonating folded line) bias unit. In FIG. 4, components having the same reference numerals as in FIGS. 1 through 3 have the same functions as FIGS. 1 through 3.

FIG. 4A is the same single folded resonator as explained in FIGS. 1 through 3. FIG. 4B is a double folded resonator having a structure in which each of the first and second folded stubs 301 and 302 is folded twice. FIG. 4C is a double folded resonator having a structure in which each of the first and second folded stubs 301 and 302 is folded twice, the thin-line interconnecting spacer 303 is also folded and the position of the DC pad 204 moves to under the impedance transformer 202. A smaller variable reactance RF unit can be disposed in a single layer in the configuration in FIG. 4B than that in FIG. 4A and a far smaller one can be disposed in that in FIG. 4C than that in FIG. 4B.

All the preferred embodiments illustrated in FIG. 4 follow such design constraints that interconnection from the antenna array unit 101 (FIG. 1) in the RF unit may become minimum and also the open folded stubs 301 and 302 and the thin-line interconnecting spacer 303 are folded in such a way as to be parallel to the H-plane (see FIG. 1) of each patch element of the antenna array unit 101. In this consideration it is assumed that the antenna array unit 101 is linearly polarized in such a way to have polarity along each side of the patch element groups 102, 103*a* and 103*b* (E and H-pole direction in FIG. 1).

In the folding in each preferred embodiment illustrated in FIG. 4, symmetry is maintained in such a way that the self cancellation of false radiation may be satisfied, in order to prevent any polarity mixture from occurring in the antenna array unit 101.

As it is clear from FIG. 3, the first and second open folded stubs 301 and 302 are folded in the opposite directions each other. As a result, stub current J1 and J2 come close to each other and are opposed to each other in such a way as to prevent false radiation. Therefore, no false radiation occurs.

Figure 5:
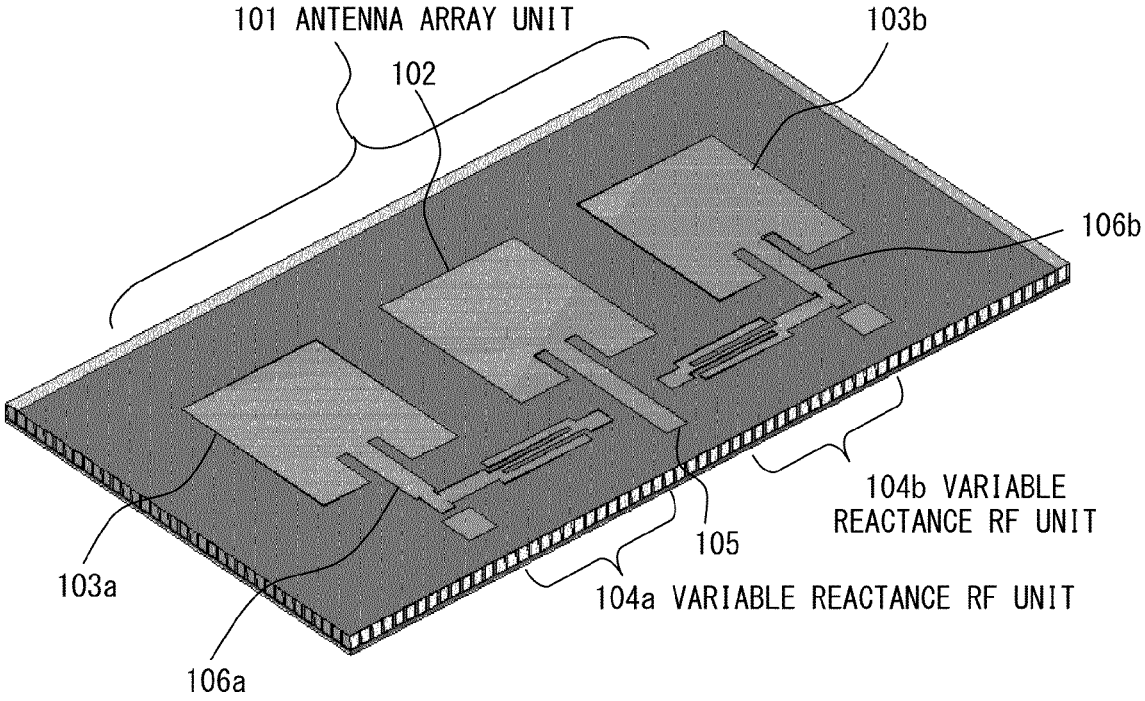
FIG. 5 is the squint perspective view of a single-layer adaptive array antenna.

FIG. 5 is the squint perspective view of a single-layer adaptive array antenna. Components having the same reference numerals as in FIG. 1 have the same functions as in FIG. 1. All the above-explained preferred embodiments can be mounted on the top layer of a PCB. Therefore, they can be easily manufactured, its material and production costs can be reduced and its weight can be reduced.

Figure 6:
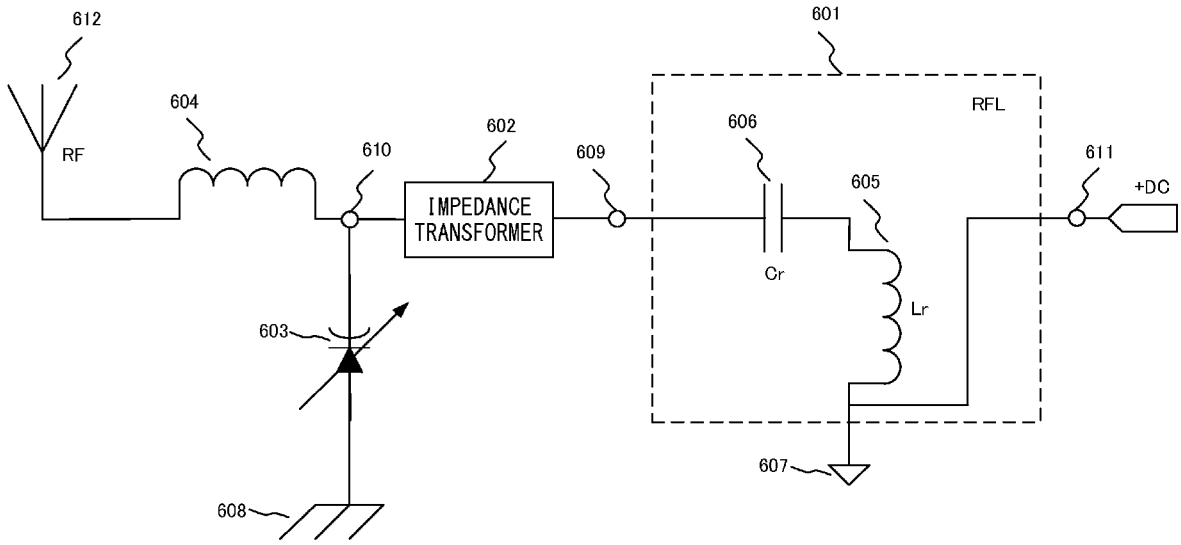

FIG. 6 illustrates the approximate concentrated constant element equivalent model for explaining the operation principle of the variable reactance RF unit 104 illustrated in FIGS. 2, 3 and the like.

The concentrated constant element is approximated as an ideal case in which all loss equivalent parameters are neglected.

A broken line block 601 indicates the approximate concentrated constant element equivalent model of the resonating folded line (RFL) bias unit 201 and includes a capacitance 605 and an inductor 606, which have the approximate concentrated constants of an inductance Lr corresponding to the first open folded stub 301 and a capacitance Cr corresponding to the second open folded stub 302 respectively, illustrated in FIG. 3.

In a preferable design frequency, since the capacitance 605 and the inductor 606 causes continuous resonance in cooperation, the RFL block 601 can be realized as RF grounding 607.

Since during resonance, the Lr and Cr cannot be seen, the RFL block 601 generates zero impedance in a node 609.

A node 611 indicates a point in which a DC voltage power source is connected.

The impedance transformer 602 is connected between the nodes 609 and 610.

Since the impedance transformer 602 is a part of a transmission line terminated at the node 609 being an RF grounding node, it behaves like an inductor.

A varactor diode 603 is connected between the node 610 and the DC grounding 608.

The DC grounding 608 differs from the RF grounding 607. Therefore, since the RF grounding 607 is seen, the impedance transformer 602 forms an LC tank circuit together with the varactor diode 603.

The LC tank circuit causes the fluctuations of input reactance in the node 610. When supplied DC voltage changes in the node 611, the capacitance value of the varactor diode 603 changes. Therefore, the varactor diode 603 causes reactance fluctuations across the LC tank circuit in the node 610.

An inductor 604 is the approximation of a 50-ohm transmission line connected to the reactance variable node 610 from the supply point of an antenna 612. The antenna 612 can be replaced by an RF circuit.

Since a short circuit appears across the varactor diode 603, it is necessary to separate the RF grounding 607 from the varactor diode 603. For that purpose, the impedance transformer 602 is provided in order to separate the RF grounding 607 from the varactor diode 603.

In the above-described equivalent circuit model, since all the parasitic impedances in the RFL bias unit 601 are short-circuited by the RFL grounding 607, such occurrence can be blocked. Since bias can be realized by RF short-circuit, DC voltage power source can be conducted to the varactor diode 603 while blocking the leakage of an RF signal to the DC voltage power source.

According to this preferred embodiment, by mounting stubs constituting a resonating folded line bias circuit as the first and second open folded stubs having folded structures, the variable reactance circuit can be miniaturized, each variable reactance circuit can be disposed in space between the respective signal feeding line of the active antenna element and each passive antenna element together with the feature of 90 degree arrangement, and the antenna array unit and the variable reactance circuit can be mounted on the single layer of a printed-circuit board.

In this case, by folding each of the first and second open folded stubs twice or more, and by also folding the thin-line interconnecting spacer, the variable reactance circuit can be further miniaturized.

Furthermore, by disposing the first and second open folded stubs in such a way that their longitudinal directions may coincide with the polarization direction (H pole) of the antenna array unit, interconnection from the antenna array unit to the variable reactance circuit can be minimized.

By also disposing the first and second open folded stubs in such a way as to be folded in the opposite direction each other, the occurrence of false radiation can be suppressed.

Furthermore, by mounting the antenna array unit and the variable reactance circuit on the top layer of a printed-circuit board, a single-layer adaptive plane array antenna device can be easily manufactured, its material and production costs can be reduced and its weight can be also reduced.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A single-layer adaptive plane array antenna device mounting an antenna array unit mounting an active antenna element and two or more passive antenna elements and two or more variable reactance circuits each of which is connected to each of the passive antenna elements and changes each reactance of a signal supplied to each of the passive antenna elements, on the same printed-circuit board, wherein the variable reactance circuit includes a variable capacitance circuit controlled by bias voltage;

a resonating folded line bias circuit having an AC grounding node for supplying the bias voltage to the variable capacitance circuit, for transmitting the bias voltage to the variable capacitance circuit including a thin line interconnecting spacer for transmitting the bias voltage to the variable capacitance circuit side and first and second open folded stubs each of which is connected to the thin-line interconnecting spacer, each of which is also disposed in parallel with a longitudinal direction of each other in a prescribed small gap with the thin line interconnecting spacer, each of which has a folded shape and each of which functions as an inductance element and a capacitance element respectively, in order to form a resonant circuit for realizing the AC grounding node; and an impedance transformer circuit for separating the variable capacitance circuit from the AC grounding node.

2. The single-layer adaptive plane array antenna device according to claim 1, wherein the variable reactance circuit is disposed at a right angle against a signal feeding line of the passive antenna element to which the variable reactance circuit is connected.

3. The single-layer adaptive plane array antenna device according to claim 1, wherein the first and second open folded stubs are folded in opposite directions each other.

4. The single-layer adaptive plane array antenna device according to claim 1, wherein the first and second open folded stubs are disposed in such a way that their longitudinal directions may coincide with a polarization direction of the antenna array unit.

5. The single-layer adaptive plane array antenna device according to claim 1, wherein respective lengths in longitudinal directions of the first and second open folded stubs differ from each other and lengths in a longitudinal direction of both are ¼ or less than a basic wavelength of a signal supplied to the passive antenna element by the variable reactance circuit.

6. The single-layer adaptive plane array antenna device according to claim 1, wherein a length in a longitudinal direction of the first open folded stub is longer than a length in a longitudinal direction of the second open folded stub.

7. The single-layer adaptive plane array antenna device according to claim 1, wherein a length in a longitudinal direction of the thin-line interconnecting spacer is ¼ or less of a basic wavelength of a signal supplied to the passive antenna element by the variable reactance circuit.

8. The single-layer adaptive plane array antenna device according to claim 1, wherein each of the first and second open folded stubs is folded twice or more.

9. The single-layer adaptive plane array antenna device according to claim 1, wherein the thin-line interconnecting spacer is folded.

10. The single-layer adaptive plane array antenna device according to claim 1, wherein the antenna array unit and each of the variable reactance circuit are mounted on a top surface of a printed-circuit board and its grounding surface is mounted on the other surface of the printed-circuit board.

11. A variable reactance circuit connected to each of passive antenna elements of an antenna array unit including an active antenna element and two or more passive antenna elements, for changing reactance of a signal supplied to the passive antenna element, the circuit comprising:

a variable capacitance circuit controlled by bias voltage;

a resonating folded line bias circuit having an AC grounding node for supplying the bias voltage to the variable capacitance circuit, for transmitting the bias voltage to the variable capacitance circuit including a thin line interconnecting spacer for transmitting the bias voltage to the variable capacitance circuit side and first and second open folded stubs each of which is connected to the thin-line interconnecting spacer, each of which is also disposed in parallel with a longitudinal direction of each other in a prescribed small gap with the thin line interconnecting spacer, each of which has a folded shape and each of which functions as an inductance element and a capacitance element respectively, in order to form a resonant circuit for realizing the AC grounding node; and an impedance transformer circuit for separating the variable capacitance circuit from the AC grounding node.

* * * * *

UNITED STATES PATENT AND TRADEMARK OFFICE

CERTIFICATE OF CORRECTION

PATENT NO. : 8,009,104 B2
APPLICATION NO. : 12/403527
DATED : August 30, 2011
INVENTOR(S) : Md. Golam Sorwar Hossain It is certified that error appears in the above-identified patent and that said Letters Patent is hereby corrected as shown below:

On the Title Page, item (75) should read as follows:

--(75) Inventor: Md. Golam Sorwar Hossain, Kawasaki (JP)--

Signed and Sealed this
Sixth Day of December, 2011

David J. Kappos

David J. Kappos
*Director of the United States Patent and Trademark Office*